United States Patent [19]

Suzuki et al.

[11] 4,336,414

[45] Jun. 22, 1982

[54] METHOD AND APPARATUS FOR TREATING NOXIOUS GASES

[75] Inventors: Toshio Suzuki, Tokyo; Junichi Ise, Yokohama; Satoru Yanabu, Machida; Hitoshi Mizoguchi, Yokohama, all of Japan

[73] Assignee: Tokyo Shibaura Denki Kabushiki Kaisha, Kawasaki, Japan

[21] Appl. No.: 189,712

[22] Filed: Sep. 22, 1980

[30] Foreign Application Priority Data

Sep. 21, 1979 [JP] Japan ..... 54/120739
Oct. 11, 1979 [JP] Japan ..... 54/129955

[51] Int. Cl.[3] ..... H01B 17/36; B03C 3/70

[52] U.S. Cl. ..... 174/14 R; 55/13; 55/15; 55/85; 55/146; 55/228; 55/71; 174/17 GF; 200/148 B; 200/148 E

[58] Field of Search ..... 55/13, 85, 15, 118–120, 55/71, 146, 228; 174/14 R, 14 BH, 17 GF, 14 R; 134/22.19; 200/148 E, 148 B

[56] References Cited

U.S. PATENT DOCUMENTS

| | | | |
|---|---|---|---|
| 1,828,631 | 10/1931 | Whitney | 55/13 |
| 2,340,898 | 2/1944 | Race | 174/14 R |
| 3,744,217 | 7/1973 | Ebert | 55/118 |
| 4,278,832 | 7/1981 | Hingorani | 55/120 |

*Primary Examiner*—Bernard Nozick
*Attorney, Agent, or Firm*—Oblon, Fisher, Spivak, McCelland & Maier

[57] ABSTRACT

Disclosed is a process and apparatus for treating noxious gases and/or substances which are produced by virtue of an electric arc in the event of a switching operation or due to corona discharge. A gas insulated electrical apparatus is connected to a container for a cleaning solution including a volatile solvent. A conduit connects the container for the cleaning solution to the gas insulated electrical apparatus, and another conduit, including a filter apparatus, connects the gas insulated electrical apparatus to the container for the cleaning solution, for returning the cleaning solution, which has been used to wash the gas insulated electrical apparatus, to the container for the cleaning solution. Vacuum or pressure producing apparatuses may be provided for aiding in the transfer of the cleaning solution.

12 Claims, 19 Drawing Figures

METHOD AND APPARATUS FOR TREATING NOXIOUS GASES

BACKGROUND OF THE INVENTION

1. Field of the Invention

The present invention concerns a process for treating noxious gases and/or substances which are produced in a gas-insulated electrical apparatus by virtue of an electric arc in the event of a switching operation or due to corona discharge, and an apparatus for carrying out the process.

2. Description of Prior Art

At the present time, the requirements for electrical energy means that metal-cased, gas-insulated electrical equipment such as power switches, circuit breakers or isolating switches, bus bars or contact rails and the like that have been incorporated in transmission lines are rising. Electrical equipment or switching equipment is already known, which is encapsulated in a metal housing, with the insulation being provided by a gas which has a high level of dielectric strength and excellent arc-suppressing properties, preferably $SF_6$ gas. Although such gases, and in particular, $SF_6$ gas, have the desired properties referred to above, they also have undesirable properties. The gas in a power switch or a circuit breaker is subject to decomposition by the electric arc, when the switch is cut in and out. Part of the decomposed gas combines with metal vapor and forms a fine-grain powder comprising fluorine compounds. The other part of the decomposed insulating gas is a gas which is injurious to health such as $SF_4$ and/or $SOF_2$. Such decomposition also occurs, although to a lesser extent, in regard to a gas-insulated bus bar or contact rail, as a result of corona discharge, with small amounts of various injurious gases being produced.

By passing the gas through a weak alkaline solution, it is possible to neutralise injurious gas because the gas is acid. However, the part of the decomposed gas which is converted to the above-mentioned fine-grain powder cannot be removed from the metal-cased equipment in this way. If for example a piece of metal-cased equipment of this kind is dismantled for the purposes of maintenance and examined, there is the danger that noxious powder can come into contact with the body of the person examining the equipment, or can be drawn in with the intake of breath. Although there is the simple expedient of removing powder from the metal-cased equipment by pouring water or a weak alkaline solution into the equipment and using one of those liquids to wash out the equipment, such a process suffers from the following disadvantage. On the one hand, the operation of washing the equipment and the drying thereof which is subsequently required requires a considerable amount of time. On the other hand, washing the equipment in this way can have the result that the equipment or parts thereof suffer from rusting. It is then difficult to remove the rust because this can only be done by dismantling the equipment or parts thereof, removing the rust therefrom, and then re-assembling the equipment.

SUMMARY OF THE INVENTION

The object of the present invention is to provide a process and an apparatus which is suitable for carrying out such a process, which make it readily possible to eliminate or render harmless noxious gas and/or powder which is produced in a metal-cased $SF_6$ gas-insulated electrical device.

According to the invention, this object is achieved in that a cleaning solution having a volatile solvent is introduced into the gas-insulated electrical equipment, said solution is used for washing within the equipment, and the solution is then rendered harmless and collected. The apparatus for carrying out the process includes a container for the cleaning solution having the volatile solvent, an apparatus connected to the gas-insulated electrical equipment for producing a vacuum, and a filter which is connected between the electrical equipment and the container, for rendering the cleaning solution harmless.

BRIEF DESCRIPTION OF THE DRAWINGS

The invention will now be described in greater detail hereinafter in the form of embodiments thereof, with reference to the accompanying drawings wherein.

DETAILED DESCRIPTION OF THE PREFERRED EMBODIMENTS

Figure 1:
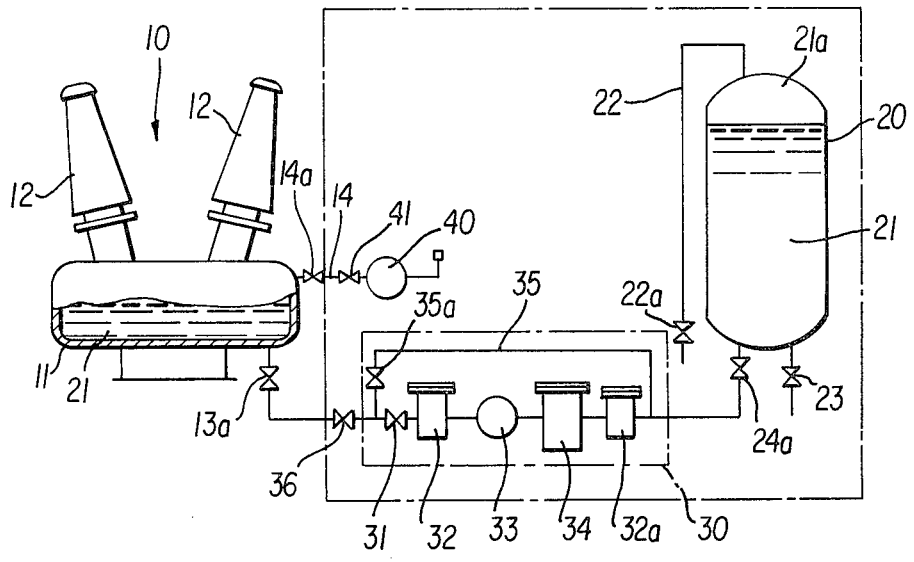
FIG. 1 shows a first embodiment of apparatus according to the invention.

Reference is made to FIG. 1 which shows a first embodiment of the apparatus according to the invention. In the form of the apparatus shown in FIG. 1, a switching device 10 represents the metal-cased electrical equipment which is insulated with $SF_6$ gas and in which gas and/or powder which is noxious to health is produced in the manner indicated hereinbefore. The switching device 10 includes within a cylindrical metal housing 11, one or more contact systems comprising switching members (not shown) which can be separated from each other. The contact system is connected by way of bushing or duct means 12 to a feed line and a discharge line (also not shown). The housing 11 is filled with $SF_6$ gas which is under a pressure of from about one to ten times atmospheric pressure. The apparatus according to the invention for neutralizing or eliminating noxious gases and/or powder is generally denoted by reference numeral 200. It includes a container 20 for containing a fluid 21 which is here referred to as a cleaning solution, for the sake of simplicity, a filter device 30, a vacuum pump 40 for reducing the pressure in the housing 11, valves 22*a*, 23, 24*a*, 36 and 41 and conduits 13, 22 and 24. The conduit 22 opens into the top of the container 20 and forms a connection to the valve 22*a*. The valve 23 is connected to the lower portion of the container 20 by way of a conduit. In addition, the lower portion of the container 20 is connected to the filter device 30 by way of the conduit 24. Disposed on the conduit 24 is the above-mentioned valve 24*a*. The filter device 30 comprises a valve 31, a dust filter 32, a suction pump 33, an oxygen filter 34 and a dust filter 32*a*, these components being connected together in series. Connected in parallel with the components 31, 32, 33, 34 and 32*a* is a conduit 35 which includes a valve 35*a*.

The filter device is connected to the housing 11 of the switching device 10 by way of the valves 13*a* and 36 and the conduit 13. The vacuum pump 40 is connected to the housing 11 by way of the valves 14*a* and 41, and the conduit 14.

$SF_6$ gas in the equipment 10 suffers decomposition by the electric arc which is produced when the device is cut in and cut out. A part of the decomposed gas combines with metal vapour which is also produced under the effect of the electric arc, and forms a fine-grain powder comprising a chemical fluorine compound. The other part of the decomposed gas is a noxious gas such as $SF_4$ and $SOF_4$. The decomposed gas is acid and is absorbed or bonded in the powder.

The cleaning solution 21 used is a volatile solvent such as alcohol, the solvent known under the trademark Freon, or a mixture of alcohol and Freon. When alcohol is used as the cleaning solution 21, the alcohol is passed into the casing 11 and evaporated therein. The resulting vapour condenses on the parts of the equipment which are disposed in the housing 11. Instead of this manner of procedure, the cleaning solution 21 can be sprayed or injected into the housing 11 in order to form a deposit on the parts of the equipment in the housing. In this way the parts of the equipment within the housing 11 can be cleaned. The copper fluorine compound forming the above-mentioned powder dissolves in alcohol. Therefore, a good cleaning action can be effected within the housing 11, in the above-indicated manner. In the event that Freon or a mixture of alcohol and Freon is used as the cleaning solution 21, the acid gas which is absorbed in the powder can be eliminated. it is also possible for the housing 11 to be filled up with the cleaning solution 21, so that the parts of the equipment within the housing 11 are washed in the cleaning solution.

The dust filters 32 and 32*a* include filter paper, polyester fleece or glass fibres. By virtue of the provision of such filters, the powder in which the decomposed gas is bound can be removed from the cleaning solution 21 which is discharged from the housing 11 after the cleaning operation therein. The oxygen filter 34 contains synthetic zeolite, activated alumina or argillaceous earth, or activated carbon. This filter 34 can filter out the decomposed gas which is dissolved in the cleaning solution 21.

The mode of operation of the apparatus 200 will be described hereinafter.

Before the cleaning solution 21 is introduced into the housing 11, a vacuum is produced in the housing by means of the vacuum pump 40. The valve 41 is then closed and the vacuum pump 40 is switched off. The valve 31 is then closed, and at the same time the valves 13*a*, 36, 35*a* and 24*a* are opened. The cleaning solution 21 is then introduced into the housing 11 by way of the conduit 35, and the switching device 10 is then left at rest for some time. The cleaning solution 21 is introduced into the housing 11 by opening the valve 22*a* and communicating the space 21*a* in the container which is above the surface of the cleaning solution 21, with atmosphere. Instead of this, it is also possible to open the valve 22*a* and to introduce nitrogen into the container 20 by way of the conduit 22. The housing 11 may be entirely or only partially filled with the cleaning solution 21. It will be appreciated that the valve 23 is closed during the filling operation.

After the components of the device which are disposed within the housing 11 have been exposed to the action of the cleaning solution 21 for a sufficiently prolonged period to remove the powder, the valve 35*a* is closed and the valve 31 is opened. The suction pump 33 is then set in operation.

The cleaning solution coming from the housing 11, which has been used therein, is then cleaned by means of the filter device 30 and thus rendered harmless, and then returned to the container 20. After the filtered cleaning solution 21 has been returned to the container 20, the vacuum pump is set in operation again. When this is done, the vacuum in the housing 11 is increased and residues of the cleaning solution 21 are evaporated. A simple drying operation can be performed within the housing 11 in this way.

The volatile solvents such as alcohol, Freon or a mixture of alcohol and Freon do not have a substantial irritation effect on the human body and also cause little or no rusting of the parts of the equipment within the housing 11. The above-described process and the apparatus which is described for carrying out the process are therefore suitable for rendering harmless noxious decomposed gas in the housing 11.

Figure 2:
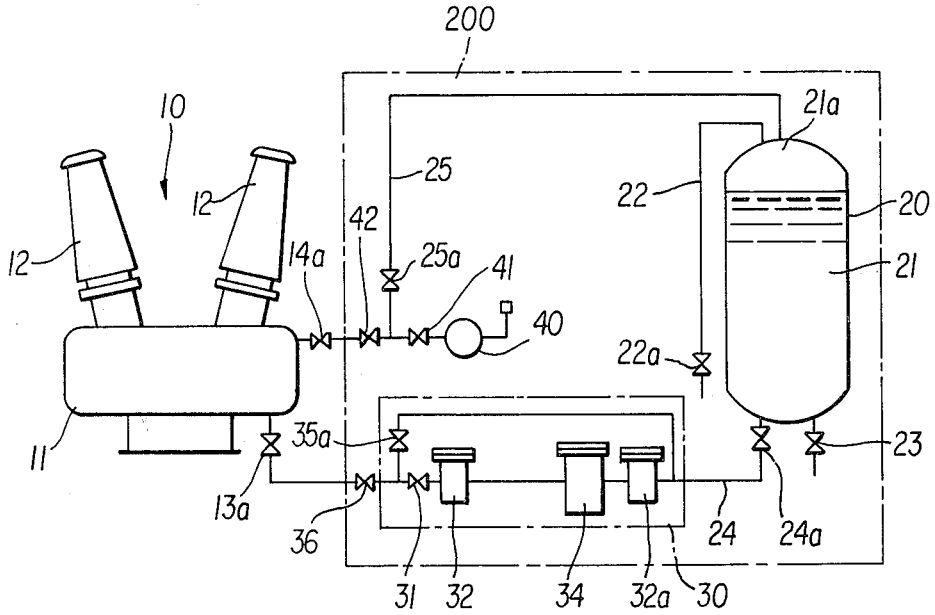
FIG. 2 shows a second embodiment of the apparatus.

FIG. 2 shows a second embodiment of the apparatus of the invention. In FIG. 2, the same components or corresponding components as those which appear in FIG. 1 are denoted by the same reference numerals as those used in FIG. 1. The construction shown in FIG. 2 does not include the suction pump denoted by reference numeral 33 in FIG. 1, which formed part of the filter apparatus 30. In addition, a conduit 25 communicates the upper portion of the container 20, by way of a valve 25*a*, with the conduit 14 between the housing 11 and the vacuum pump 40. The conduit 14 has valves 41 and 42 respectively, on both sides of the junction between the conduits 25 and 14.

The mode of operation of this second embodiment of the apparatus of the invention is as follows:

Firstly, the valves 36 ad 25*a* are closed and the valves 14*a*, 41 and 42 are opened. The housing 11 is then pumped substantially free of gas, by means of the vacuum pump 40. The valves 41 and 42 are then closed and cleaning solution 21 is introduced into the housing 11 in the same manner as described above in relation to the first embodiment. If, after the period of time for which the cleaning solution 21 is acting on the components in the housing 11, the cleaning solution 21 is to be removed from the housing 11, the valves 25*a* and 41 are then closed and a vacuum is produced in the upper portion 21*a* of the container 20 by means of the vacuum pump 40, while the upper portion of the housing 11 is brought into communication with atmosphere by means not shown in the drawing. In this operation, the valve 35*a* is closed and the valve 31 is open so that the used cleaning solution 21 from the housing 11 is drawn back into the container 20 through the filter device 30. In this operation, the cleaning solution 21 which has produced the cleaning action within the housing 11 is in turn cleaned and rendered harmless, by means of the filter device 30.

Figure 3:
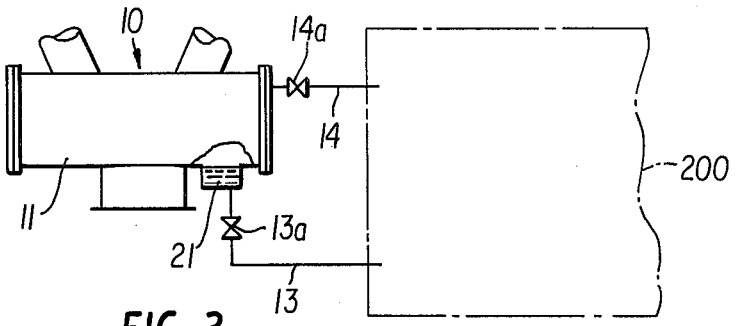
FIGS. 3 and 4 show particular embodiments of a housing of the switching equipment.

FIG. 3 shows a specific embodiment of the housing 11 of the switching equipment 10, which is particularly suitable for use in conjunction with the apparatus according to the invention. The housing 11 in this construction has a depression 15 in its bottom. The conduit 13 which includes the valve 13*a* opens into the depression 15.

In this case, the housing 11 is first pumped free of gas, by way of the conduit 14. Thereafter, cleaning solution 21 is introduced only into the depression 15 in the housing 11. The cleaning solution 21 vaporizes and thus produces the cleaning action within the housing 11. This therefore makes it possible to save on the amount of cleaning solution 21 used.

Figure 4:
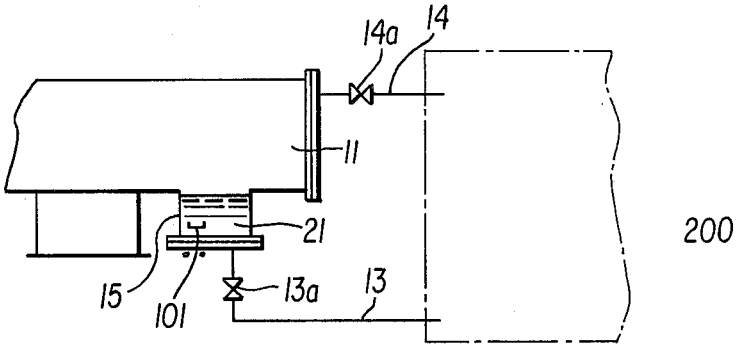

Reference will now be made to FIG. 4 which shows that the construction of FIG. 3 can be advantageously modified by arranging an ultrasonic oscillator 101 within the depression 15 at the bottom of the housing 11. The ultrasonic oscillations which are produced in the cleaning solution 21 by the oscillator 101 accelerate evaporation of the cleaning solution 21, thereby resulting in a shortened cleaning time.

Figure 5:
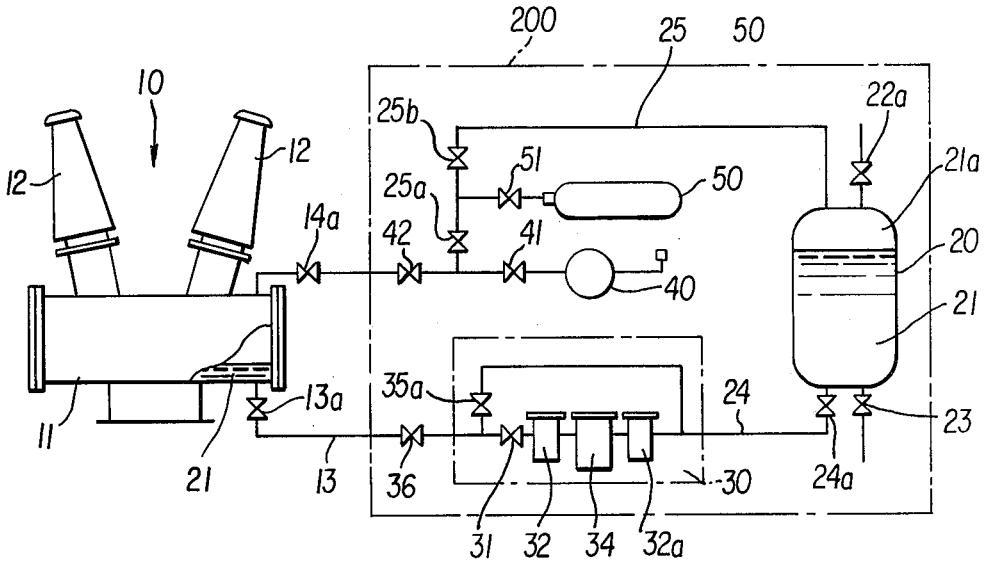
FIGS. 5 through 11 show similar views to those of FIGS. 1 and 2, of third through ninth embodiments of the apparatus of the invention.

FIG. 5 shows a third embodiment of the apparatus according to the invention, wherein the same reference numerals as those used in relation to the embodiments of FIGS. 1 and 2 are again employed. This FIG. 5 embodiment is similar to the second embodiment of the apparatus as shown in FIG. 2. In this construction, a pressure container 50 which is filled with a pressurised non-combustible gas such as $SF_6$ or nitrogen is connected to the conduit 25 by way of a valve 51. The conduit 25 includes valves 25*a* and 25*b* disposed on respective sides of the junction between the conduit 25 and the conduit leading to the valve 51 and thus the container 50.

When, in this construction, the cleaning solution 21 is to be introduced into the housing 11 from the container 20, a vacuum is produced in the housing 11 by means of the vacuum pump 40. The valves 41, 14*a* and 31 are then closed and the valves 13*a*, 36, 35*a* and 24*a* are opened in order to introduce the cleaning solution 21 into the housing 11. The valves 51 and 25*b* are also opened so that the gas flows from the pressure container 50 into the upper part 21*a* of the container 20 and, by virtue of the increased pressure in the container 20, accelerates the flow of cleaning solution 21 into the housing 11.

When the cleaning solution 21 is to be returned to the container 20, the valves 25*b*, 31 and 45*a* are put in a closed condition and the valves 22*a*, 51, 25*a*, 42, 14*a*, 13*a*, 36 and 31 are opened. The gas from the container 50 now flows into the housing 11 and the pressure which is thus developed in the housing 11 causes the cleaning solution 21 to be returned through the filter device 30 to the container 20. In this way the cleaning solution 21 can be returned to the container 20, without the use of a suction pump.

Figure 6:
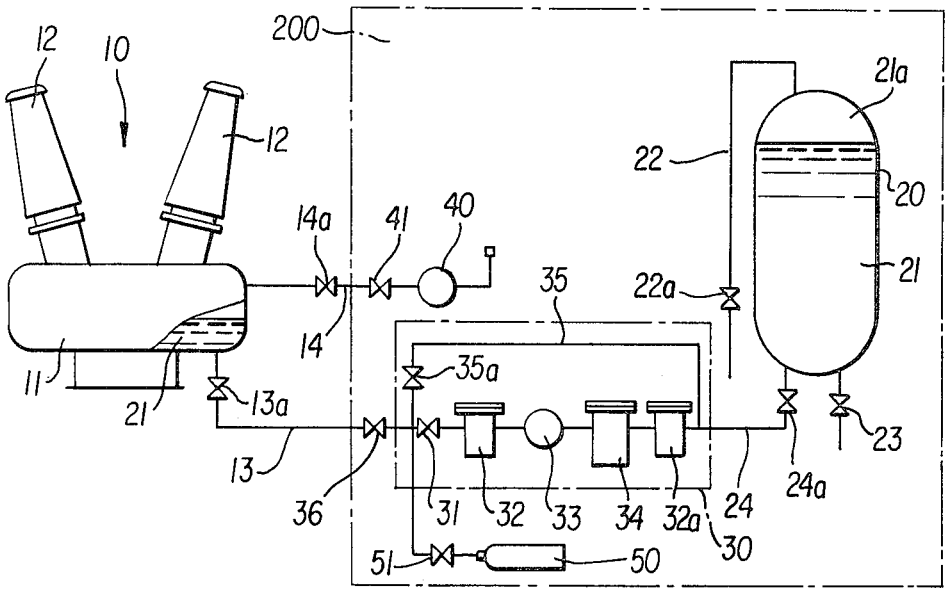

FIG. 6 shows a fourth embodiment of the invention, wherein the same reference numerals as in the preceding Figures are employed in relation to the same or corresponding components.

In this embodiment, a pressure container or vessel 50 which is filled with non-combustible gas such as $SF_6$ or nitrogen is connected by way of a valve 51 to a position between the two valves 31 and 36 on the conduit 13, and thereby connected to the filter device 30. After the cleaning solution 21 has been introduced into the housing 11 in the manner described above, the valves 35*a* and 31 are closed and the valves 13*a*, 36 and 51 are opened. Thereupon, the gas flows from the pressure vessel 50 into the housing 11, with the result that the cleaning solution 21 in the housing is splashed and spattered, thereby producing a high-speed cleaning action within the housing 11. After the cleaning operation, the valve 35*a* is kept in a closed condition and the valve 31 is opened so that the cleaning solution 21 can be returned from the housing 11 by way of the filter device into the container 20, by operation of the pump 33.

Figure 7:
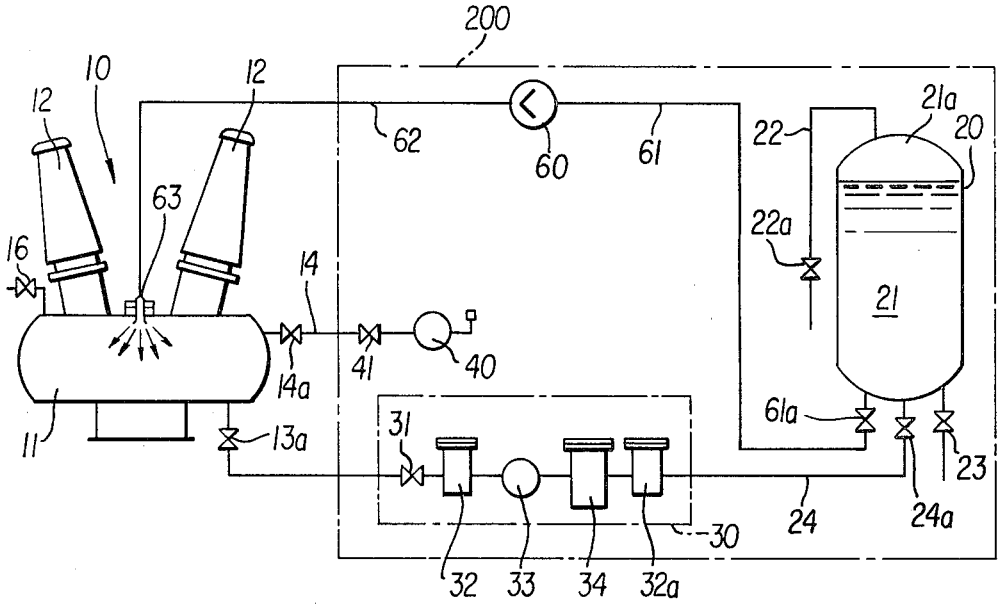

FIG. 7 shows a fifth embodiment of the apparatus, with the same reference numerals denoting the same components as in FIG. 1. Connected to the bottom of the container 20 is a valve 61*a* while a nozzle 63 on the one hand and a valve 16 on the other hand are provided on the top of the housing 11. Conduits 61 and 62 connect the valve 61*a* to the nozzle 63, by way of a pump 60. For the purposes of performing the cleaning operation with this construction, the housing 11 is emptied of gas or air and then the pump 60 is set in operation, with the valves 61*a* and 22*a* in an open condition. In this way the cleaning solution is sprayed within the housing 11, by means of the nozzle 63. The vacuum which is previously produced in the housing 11 ensures that the inflow of cleaning solution 21 into the housing does not result in the formation of an increased pressure in the housing, which would otherwise prevent or impede the spraying effect. The same purpose can also be achieved by opening the valve 16. The desired cleaning action can be accomplished within the housing 11, in the above-described manner, without the necessity of the housing 11 being filled with the cleaning solution 21.

Figure 8:
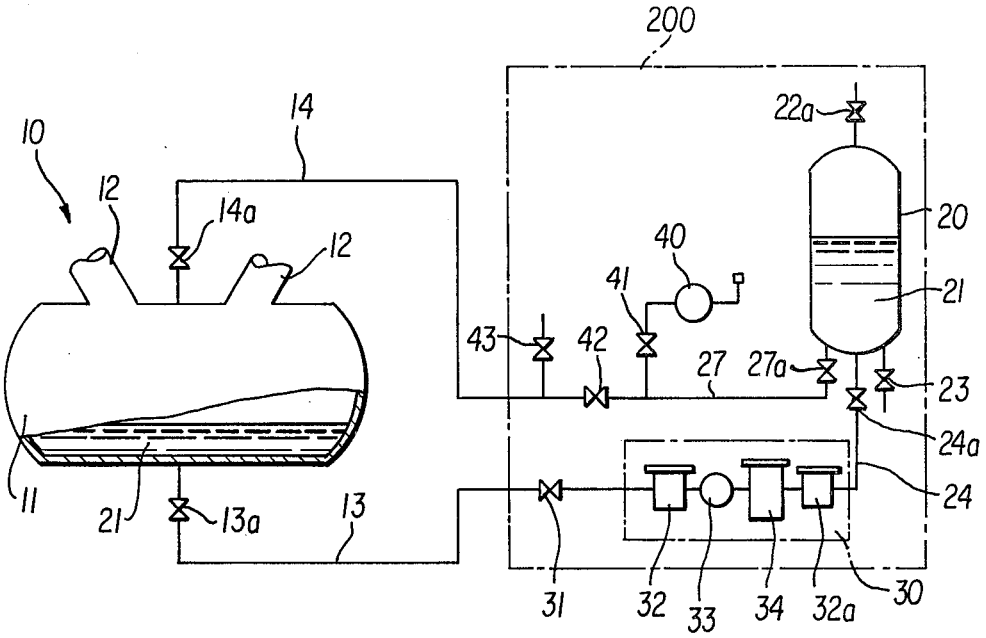

FIG. 8 shows a sixth embodiment of the invention, the same reference numerals as in relation to the embodiment of FIG. 7 being employed. A valve 27*a* is connected to the bottom of the container 20 while a valve 14*a* is connected to the top of the housing 11 of the switching equipment 10. Conduits 14 and 27 connect the valve 14*a* to valve 27*a*, by way of valve 42. The vacuum pump 40 is connected to the conduit 27 by way of the valve 41. The conduit 14 is connected to a valve 43 for opening communication of the conduit 14 to the atmosphere.

When, with this construction, cleaning solution 21 is to be introduced into the housing 11, the valves 13*a*, 27*a* and 43 are firstly closed while the valves 14*a*, 42 and 41 are opened and the housing 11 is evacuated by means of the vacuum pump 40. The valve 41 is then closed and the valve 27*a* is opened, and cleaning solution 21 is introduced into the housing 11 through the conduits 27 and 14.

Figure 9:
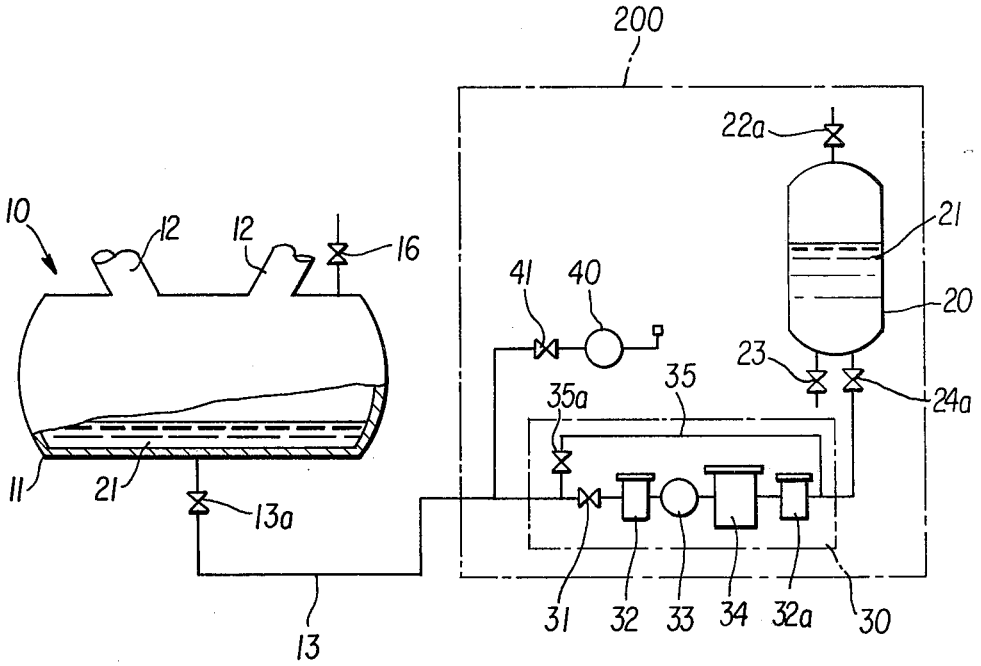

Reference is now made to FIG. 9 showing a seventh embodiment of the invention. The same reference numerals as those employed in FIG. 1 are also used for corresponding components in FIG. 9.

Connected to the top of the housing 11 is a valve 16. As opposed to FIG. 1, in the FIG. 9 construction the vacuum pump 40 is connected by way of valve 41 to the conduit 13 which connects the filter device 30 to the housing 11 by way of valve 13*a*. When cleaning solution 21 is to be introduced into the housing 11 in the FIG. 9 embodiment, the valves 16, 31 and 35 are firstly closed and the valves 13*a* and 41 are opened. The housing 11 can then be evacuated by operation of the vacuum pump 40. The valve 41 is then closed and the valves 35*a* and 24*a* are opened, and cleaning solution is introduced into the housing 11 by way of the conduits 13 and 35.

Figure 10:
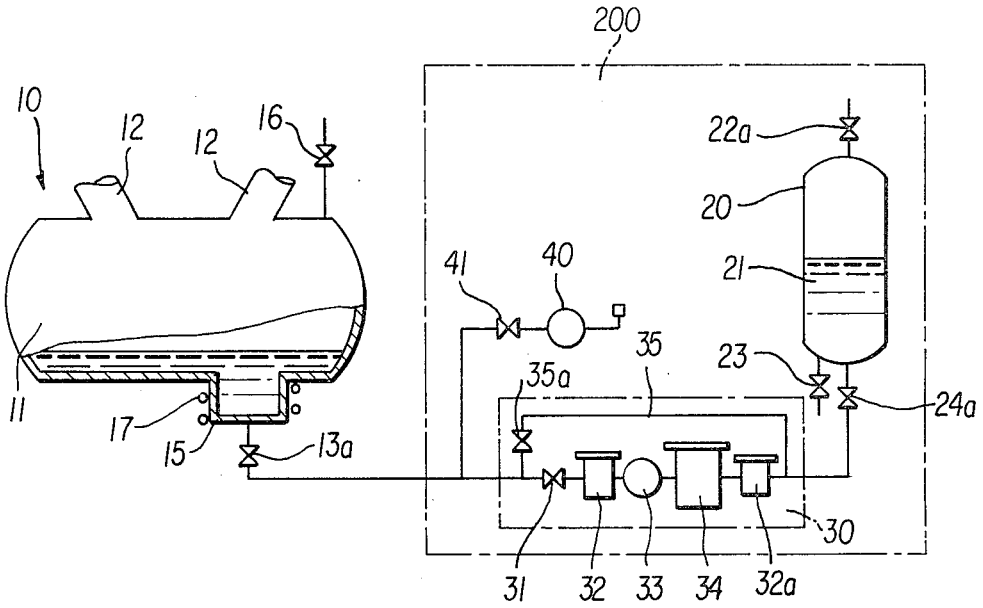

FIG. 10 shows an eighth embodiment of the invention, wherein the same reference numerals as in FIG. 9 are used to denote corresponding components. The bottom of the housing 11 of the equipment 10 has a recess or depression 15. The conduit 13 is connected by way of valve 13*a* to the depression 15 in the bottom of the housing 11. The depression 15 is provided with a heating means indicated at 17. After cleaning solution has been introduced only into the depression 15 in the bottom of the housing 11, in the manner described above with reference to FIG. 9, the cleaning solution is evaporated by means of the heating means 17, thereby producing the desired cleaning action.

Figure 11:
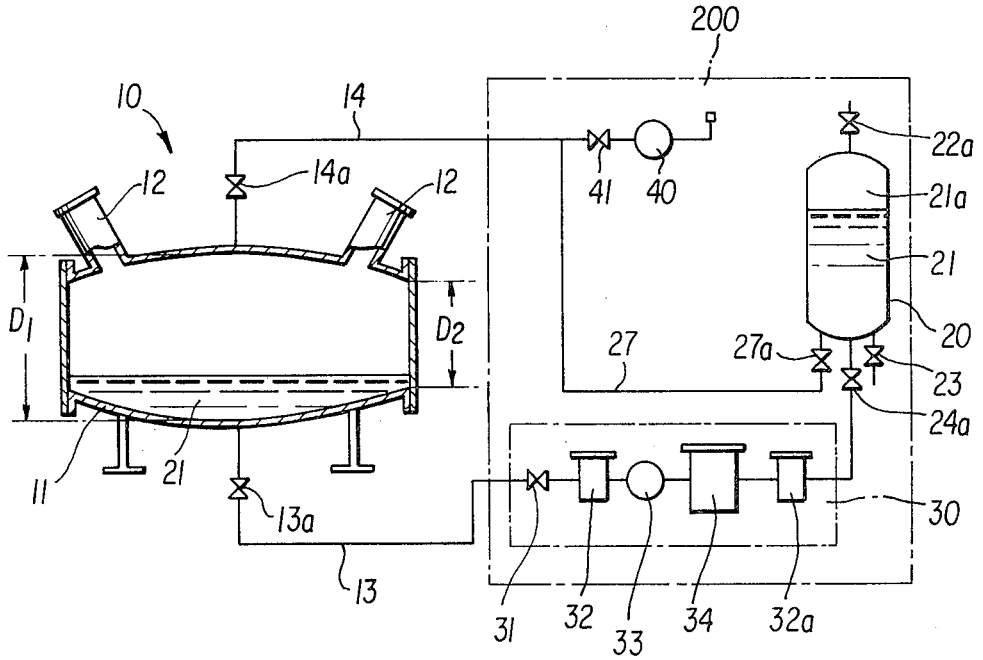

FIG. 11 shows a ninth embodiment, and the same reference numerals as those used in FIG. 8 are employed to denote corresponding components. At its middle part, the housing 11 is of larger diameter, indicated by $D_1$, than its diameter indicated by $D_2$ at its end or edge. The conduit 13 is connected to the middle portion of the housing 11, by way of the valve 13*a*. This arrangement gives the advantage that, when the housing 11 is being emptied after the cleaning operation, all the cleaning solution 21 can be removed from the housing as the cleaning solution flows to the lowest point of the housing, this being the point at which the discharge, namely the conduit 13, is connected. This construction is therefore economical in regard to the amount of cleaning solution 21 used.

Figure 12:
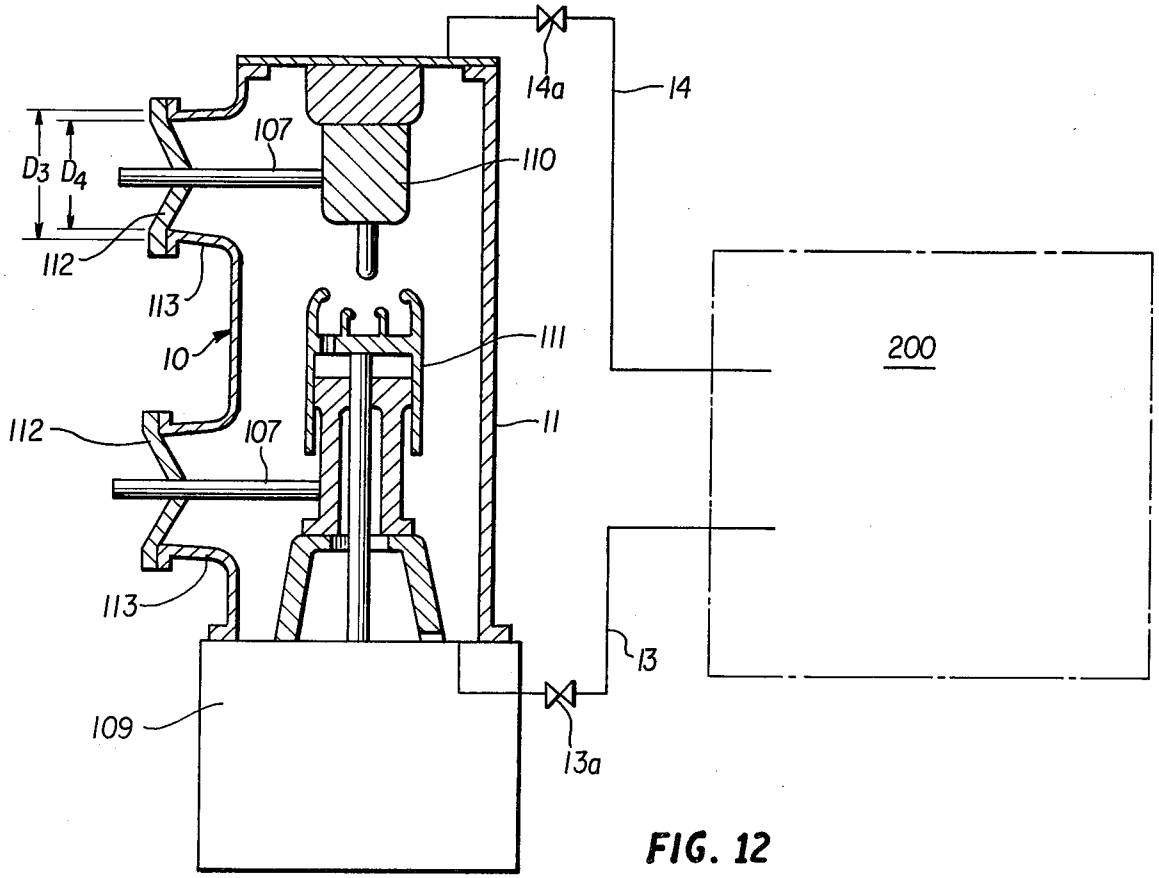
FIG. 12 shows a tenth embodiment with a detailed sectional view of the switching equipment.

FIG. 12 shows a detailed sectional view of the switching equipment 10, as used with a tenth embodiment of the invention. The equipment 10 includes an actuating mechanism or switching actuating means 109, and the housing 11. Disposed in the housing 11 is a contact system comprising two switching members which are adapted to be separated from each other, namely a contact member which is denoted by reference numeral 110 and which is secured to the housing 11, and a second contact member 111 which is connected to the switching actuating means 109. The housing 11 is filled with $SF_6$ gas. Central conductor sections 107 which extend through adaptor projections 113 are connected to the contact members 110 and 111 respectively, by way of the end of each conductor section 107 which is towards the right in FIG. 12. The conductor sections 107 extend through disc-shaped spacer members 112. At the place at which the projections 113 open into the housing 11, they are of larger diameter, as indicated by $D_3$, than their diameter $D_4$ at their outwardly projecting free end. This configuration ensures that no cleaning solution remains in the projections 113 after the cleaning operation and after the cleaning solution has subsequently been withdrawn from the housing. This therefore means that the housing 11 can be easily dried.

Figure 13:
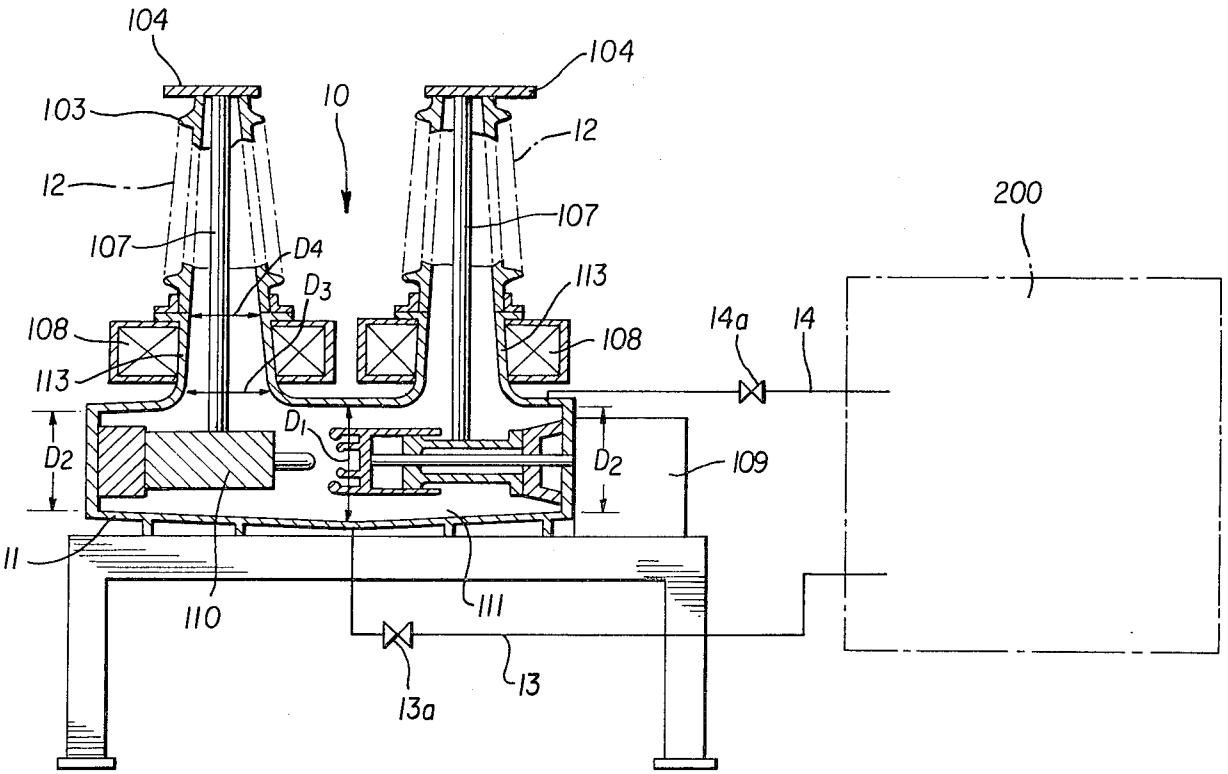
FIG. 13 shows an eleventh embodiment with a detailed view of the switching equipment.

FIG. 13 shows an eleventh embodiment and the same reference numerals as those used in FIG. 12 are employed in relation to corresponding components. As in FIG. 11, the housing 11 is of larger diameter $D_1$ at its central portion than at its end portion, as indicated at $D_2$. The conduit 13 is connected to the central portion of the housing 11 by way of the valve 13*a*. The lower ends of respective conductor sections 107 which extend through bushing or duct insulators 103 are connected to respective contact members 110 and 111. The conductor sections 107, the insulators 103 and the cable end stops or terminations 104 form the conductor bushings or ducts 12. A current transformer 108 is disposed on the outside of the projections 113. As in FIG. 12, and for the purpose discussed in relation thereto, the projections 113 are of larger diameter ($D_3$) at the place at which they open into the housing 11, than at the end (as indicated at $D_4$) which is connected to the bushing or duct 12.

Figure 14:
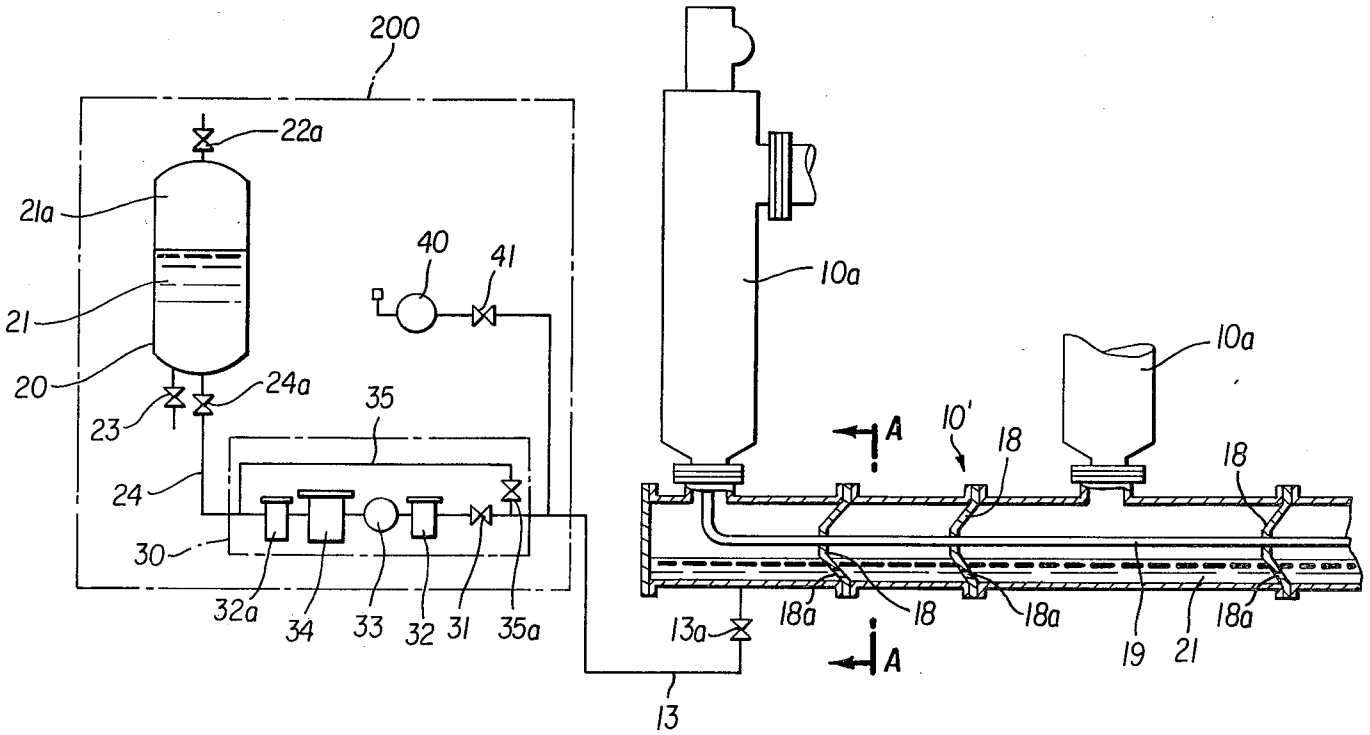
FIG. 14 shows a twelfth embodiment of the apparatus of the invention, in conjunction with a gas-insulated bus bar as the electrical switching equipment.

FIG. 14 shows a twelfth embodiment of the invention, wherein corresponding components are again denoted by the same reference numerals as those used in FIG. 9. In this construction, the apparatus according to the invention, as indicated generally at 200 is connected to a piece of electrical equipment in the form of a bus bar or contact rail which is generally denoted by reference numeral 10'. The electrical bar 10' which is insulated with $SF_6$ gas includes a plurality of housings 11, a conductor section 19 and a plurality of disc-shaped spacer members 18. The conductor section 19 extends through the spacer members 18 which are each arranged between two respective housings 11. The housings 11 are filled with $SF_6$ gas. Gas-insulated contact breakers or isolating switches 10*a* are connected to the bar 10'. The spacer members 18 have a hole 18*a*, thereby forming a communication between the chambers of the respective housings 11.

Figure 15:
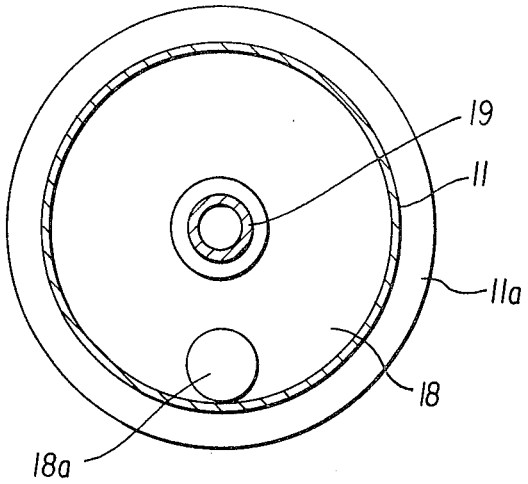
FIG. 15 shows a view in section taken along line A—A in FIG. 14.

FIG. 15 shows a view in section taken along line A—A in FIG. 14. In FIG. 15, reference numeral 11*a* denotes a flange. It is advantageous for the hole 18*a* to be arranged in the lower portion of the respective spacer members 18 so that the cleaning solution 21 can flow from one housing 11 into the other, through the hole 18*a*.

Figure 16:
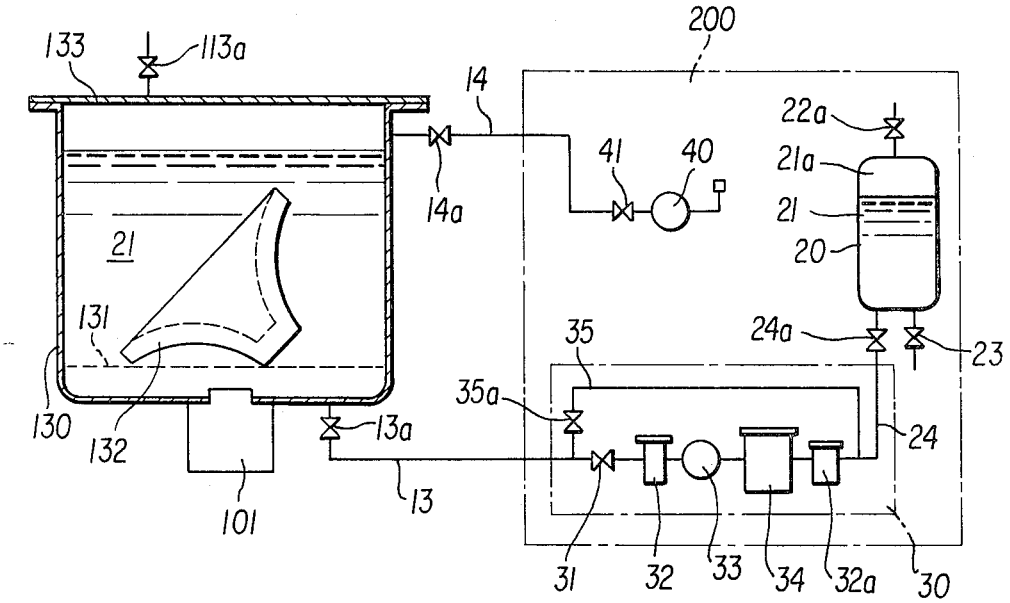
FIG. 16 shows an embodiment of the apparatus according to the invention, in conjunction with a cleaning container.

FIG. 16 shows a thirteenth embodiment, wherein the same reference numerals as those used in FIG. 1 are employed in relation to corresponding components. While the apparatus 200 in the embodiment of FIG. 1 is connected to a switching device 10, in the embodiment of FIG. 16 it is alternatively connected to a cleaning container 130. The gas-insulated switching device to be cleaned comprises various components, for example insulated spacer members, an insulated switch-actuating thrust rod, a first and a second contact member, a screening means, and the like. For the purposes of cleaning, these various components are put into the cleaning container 130. A grid-like or mesh-like plate or screen 131 is disposed in the container, above the bottom thereof, while the conduit 13 is connected by way of the valve 13*a* to the bottom of the container. Also arranged at the bottom of the container is an ultrasonic oscillator 101 while the conduit 14 is connected to the side of the container 130, by way of valve 14*a*. A cover 133 which is connected to a valve 133*a* closes the cleaning container 130. As in the embodiment of FIG. 1, the conduits 13 and 14 form a connection to the filter device 30 and to the vacuum pump 40 respectively.

The mode of operation of this arrangement is as follows:

The cover 133 hermetically seals the cleaning container 130 in which the component 132 of the switching device is disposed. As described with reference to FIG. 1, the cleaning container 130 is then evacuated by means of the vacuum pump 40 and cleaning solution 21 is then introduced thereinto until the component 132 is immersed in cleaning solution. Ultrasonic oscillation of the cleaning solution 21 in the container is then produced by means of the ultrasonic oscillator 101 in order to eliminate noxious gases and/or substances which still cling to the component 132. The cleaning solution 21 is then returned to the container 20 through the filter device 30.

Figure 17:
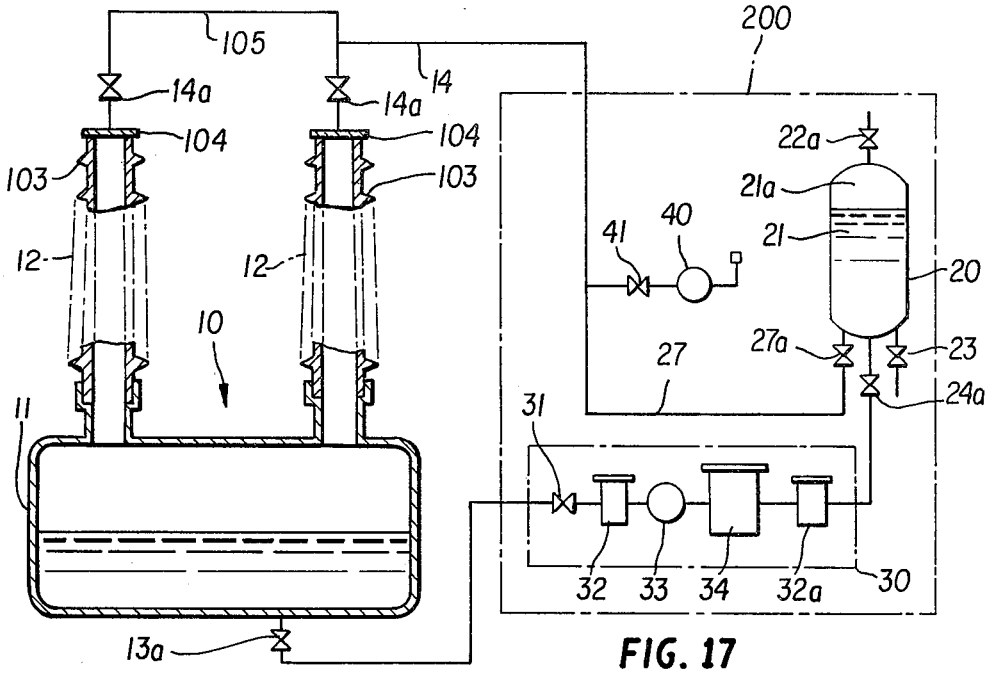
FIGS. 17 and 18 show further embodiments of the invention.

FIG. 17 shows a fourteenth embodiment of the invention wherein the same reference numerals as those used in FIGS. 8 and 13 are employed to denote the same components. In this case, conduits 105 and 14 respectively are connected by way of valves 14*a* to the cable terminations 104 of the bushings or ducts 12. The conduit 13 is connected by way of valve 13*a* to the underside of the housing 11. In this way it is possible to clean within the ducts 12.

Figure 18:
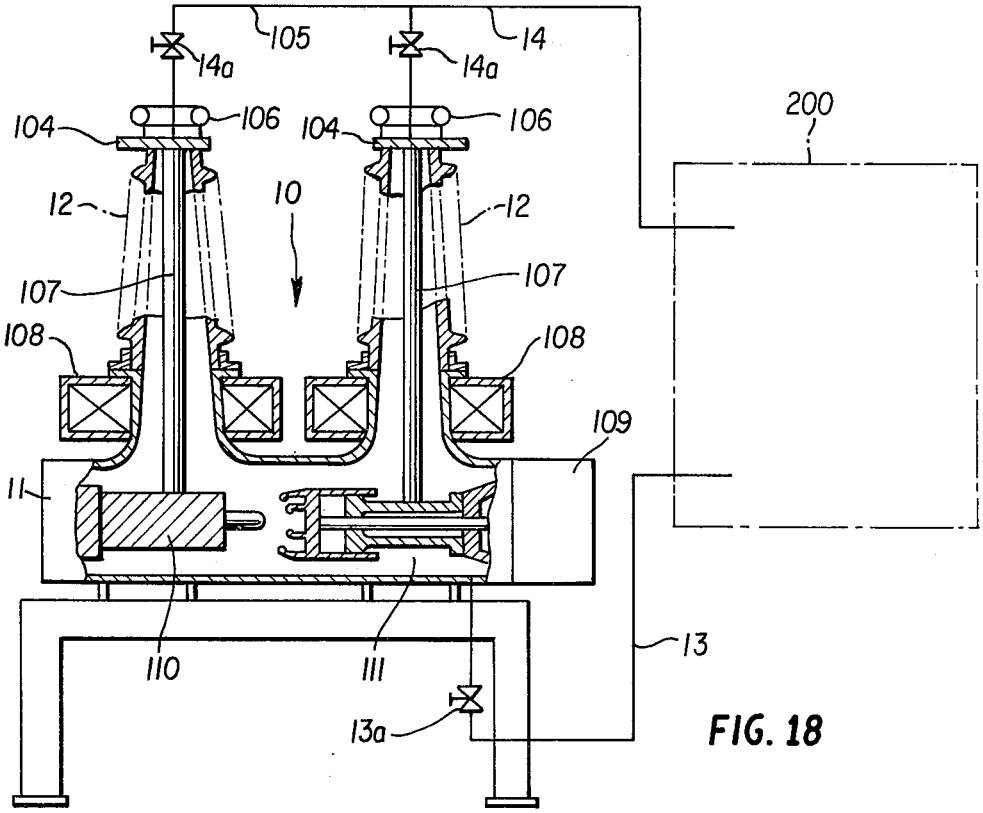

FIG. 18 shows a fifteenth embodiment of the invention, with the same reference numerals as those used in FIGS. 13 and 17 being employed for the same components. Screening means 106 are arranged at the cable terminations 104 of the intermediate bushings or bushing insulators 103, and the respective lower ends of central conductor sections 107 which extend through the insulators 103 are connected to the respective contact members 110 and 111. The conduits 14 and 105 are connected to the conductor sections 107 through the cable terminations 104. The conductor sections 107 are of a hollow construction and are provided with a plurality of holes 109, as shown in FIG. 19.

Figure 19:
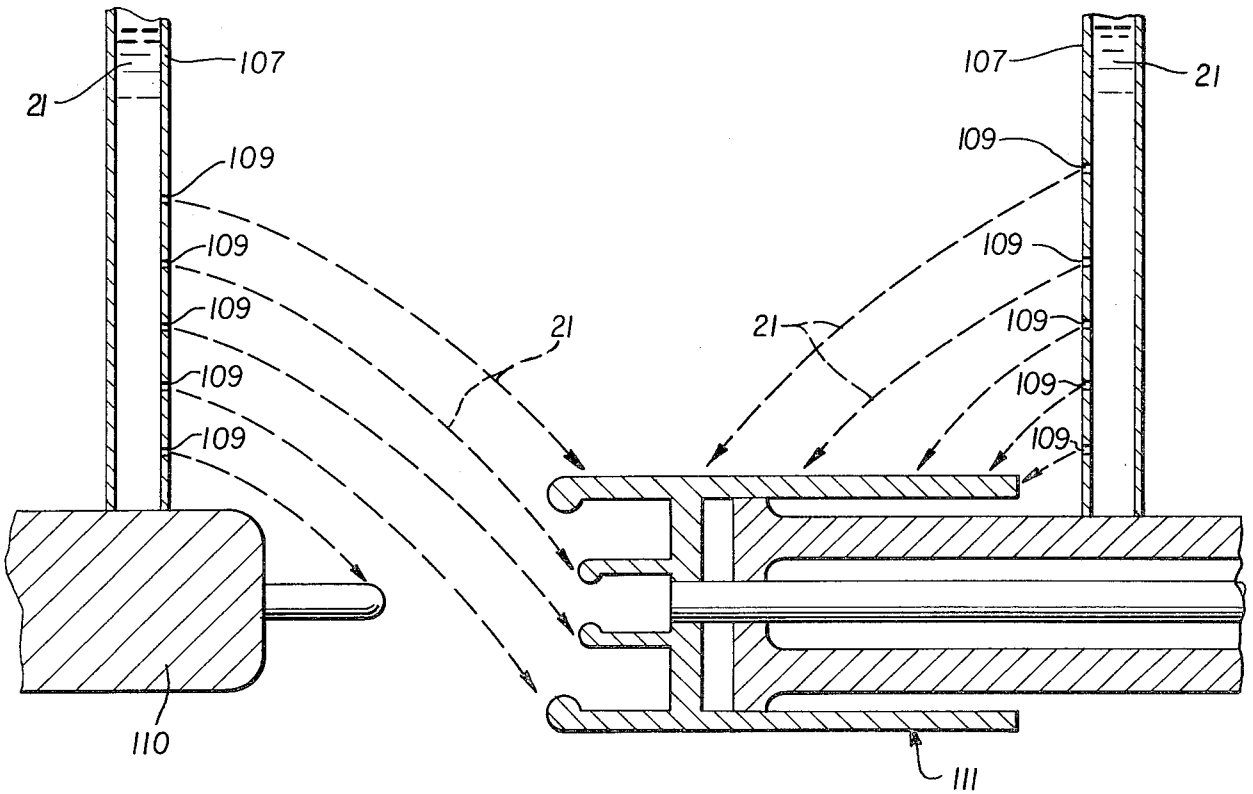
FIG. 19 shows a sectional view of a detail of FIG. 18.

FIG. 19 shows a sectional view on an enlarged scale of a part of FIG. 18.

After the housing 11 has been evacuated, the cleaning solution 21 is poured into the housing 11 through the conduits 14 and 15. The cleaning solution sprays out into the container 11 through the holes in the hollow conduits; whereby the contact members 110 and 111 in particular, can be cleaned.

We claim:

1. An apparatus for treating noxious gases and substances which are produced by virtue of an electric arc in the event of a switching operation, said apparatus comprising:

a gas insulated electrical housing;

a container for a cleaning solution which includes a volatile solvent;

introducing means connected between said gas insulated electrical housing and said container for introducing said cleaning solution to said gas insulated electrical housing, whereby said electrical housing may be washed;

vacuum means connected to said gas insulated electrical housing for reducing the pressure therein;

collecting means connected between said gas insulated electrical housing for returning all of said cleaning solution to said container; and filter means associated with said collecting means for rendering said cleaning solution harmless.

2. Apparatus according to claim 1 wherein an ultrasonic oscillator for rapid evaporation of the cleaning solution is positioned within the electrical housing.

3. Apparatus according to claim 2 wherein said housing is provided in its bottom with a depression, wherein cleaning solution can be introduced into said depression, and wherein said ultrasonic oscillator is disposed in said depression.

4. Apparatus according to claims 1 or 2 or 3 wherein said filter means includes a series connection of dust filters and an oxygen filter, and wherein a conduit is connected in parallel with respect to the dust filters and the oxygen filter, by way of a valve.

5. Apparatus according to claims 1 or 2 or 3 wherein said filter means includes a suction pump.

6. Apparatus according to claims 1 or 2 or 3 including means for subjecting the cleaning solution to pressure.

7. Apparatus according to claims 1 or 2 or 3 including means for splashing the cleaning solution within the electrical housing.

8. Apparatus according to claim 7 wherein said splashing means is a pressure vessel filled with non-combustible gas.

9. Apparatus according to claims 1 or 2 or 3 including means for spraying the cleaning solution into the electrical housing.

10. Apparatus according to claim 9 wherein said spraying means include a pump, a nozzle disposed on the electrical housing, and a conduit means which connects the nozzle by way of the pump to the container for the cleaning solution.

11. A process for treating noxious gases and substances which are produced in a gas-insulated electrical housing by virtue of an electric arc due to corona discharge during a switching operation, comprising introducing a cleaning solution including a volatile solvent into the gas-insulated electrical housing, utilizing said solution to wash the contaminants resulting from said corona discharge within the apparatus, rendering the solution harmless by removing said contaminants, collecting the solution, and applying a vacuum to said housing by vacuum producing means before introducing said cleaning solution for reducing the pressure in said housing.

12. A process for treating noxious gases and substances which are produced in a gas-insulated electrical housing by virtue of an electric arc due to corona discharge during a switching operation, comprising introducing a cleaning solution including a volatile solvent into the gas-insulated electrical housing, utilizing said solution to wash the contaminants resulting from said corona discharge within the apparatus, rendering the solution harmless by removing said contaminants, collecting the solution, and applying a vacuum to said housing by vacuum producing means after introducing said cleaning solution, for reducing the pressure in said housing.

* * * * *